US005110786A

United States Patent [19]

Arai et al.

[11] Patent Number: 5,110,786

[45] Date of Patent: May 5, 1992

[54] HEAT-SENSITIVE RECORDING MATERIAL

[75] Inventors: Naoto Arai, Ikeda; Nobuo Kanda, Neyagawa; Masaharu Nojima, Amagasaki, all of Japan

[73] Assignee: Kanzaki Paper Manufacturing Co., Ltd., Tokyo, Japan

[21] Appl. No.: 508,898

[22] Filed: Apr. 12, 1990

[30] Foreign Application Priority Data

Apr. 28, 1989 [JP] Japan ..... 1-109769

[51] Int. Cl.[5] ..... B41M 5/30

[52] U.S. Cl. ..... 503/204; 427/151; 503/208; 503/209; 503/221

[58] Field of Search ..... 427/150-152; 503/208, 209, 221, 225, 204

[56] References Cited

U.S. PATENT DOCUMENTS 4,473,831 9/1984 Watanabe ..... 503/209

4,771,033 9/1988 Shimizu et al. ..... 503/209

*Primary Examiner*—Bruce H. Hess

*Attorney, Agent, or Firm*—Morgan & Finnegan

[57] ABSTRACT

A heat-sensitive recording material comprises a recording layer formed on a base sheet where the recording layer comprises a colorless or pale colored basic chromogenic material, a color developing material which develops a color by contacting with said chromogenic material, and a stabilizer. The recording layer comprises at least one selected from the group consisitng of 3-(N-methyl-N-cyclohexyl)amino-6-methyl-7-phenylaminofluoran, 3-diethylamino-6-methyl-7-phenylaminofluoran and 3-(N-ethyl-N-tetrahydrofurfuryl)amino-6-methyl-7-phenylaminofluoran together with 3-di(n-butyl)amino-6-methyl-7-phenylaminofluoran as the chromogenic material, and at least one selected from the group consisting of 1,1,3-tris(3-cyclohexyl-4-hydroxy-6-methylphenyl)butane, 1,1,3-tris(2-methyl-4-hydroxy-5-tert-butylphenyl)butane and 4,4'-cyclohexylidenediphenol as the stabilizer, so that a heat-sensitive recording material in which both of the brightness of the background area and the optical density of the recorded images are stably maintained under high temperature condition can be obtained.

6 Claims, No Drawings

HEAT-SENSITIVE RECORDING MATERIAL

FIELD OF THE INVENTION

This invention relates to a heat-sensitive recording material and particularly to a heat-sensitive recording material having a high sensitivity and being superior in retainability of the recorded images and having a background area less susceptible to lowering the brightness.

BACKGROUND AND OBJECT OF THE INVENTION

There has been well-known heat-sensitive recording materials utilizing the colorforming reaction between a colorless or pale colored basic chromogenic material and an organic or inorganic color developer, in which color images are produced by heating to contact with each other of the basic chromogenic material and the color developer.

These heat-sensitive recording materials are relatively cheap and the recording machines are compact and easily maintained. Therefore, they have been used in the various fields. However, when the heat-sensitive recording materials are generally allowed to stand in an atmosphere of about 40° C. for a long time, for example in the course of transportation or in the storehouse, undesired colorforming reaction (fogging) is partially occurred. Particularly in high-sensitive heat-sensitive recording materials, the brightness of the background area is remarkably lowered. Therefore, it has been strongly desired to develop heat-sensitive recording materials in which the brightness is not substantially lowered by exposing to high temperature condition for a long time.

Generally, heat-sensitive recording materials do not have sufficient retainability of the recorded images. Particularly the recorded images are discolored by exposing to high temperature condition for a relatively short time. To improve the image retainability, there have been proposed various methods in which an agent for improving the image retainability is used. However, with use of the conventional agents for improving the image retainability, a sufficient effect is not obtained, or a new problem such as a lowering of brightness of the background area occurs even if an agent having an effect for the retainability of the recorded images at high temperature is used, the desired results can not be always obtained.

Therefore, it has been strongly desired to provide a heat-sensitive recording material in which the background area is less susceptible to a lowering of brightness by storing under high temperature condition and the recorded images are stably maintained.

The object of the present invention is to provide a heat-sensitive recording material in which both of the brightness of the background area and the optical density of the recorded images are stably maintained under high temperature condition.

SUMMARY OF THE INVENTION

A heat-sensitive recording material according to the invention comprises a recording layer formed on a substrate where the recording layer comprises a colorless or pale colored basic chromogenic material, a color developing material which develops a color by contacting with said chromogenic material, and a stabilizer. The recording layer comprises at least one selected from the group consisting of 3-(N-methyl-N-cyclohexyl)amino-6-methyl-7-phenylaminofluoran, 3-diethylamino-6-methyl-7-phenylaminofluoran and 3-(N-ethyl-N-tetrahydrofurfuryl)amino-6-methyl-7-phenylaminofluoran together with 3-di(n-butyl)amino-6-methyl-7-phenylaminofluoran as the chromogenic material, and at least one selected from the group consisting of 1,1,3-tris(3-cyclohexyl-4-hydroxy-6-methylphenyl)butane, 1,1,3-tris(2-methyl-4-hydroxy-5-tert-butylphenyl)butane and 4,4'-cyclohexylidenedi phenol as the stabilizer.

Naturally, heat-fusible materials may be further comprised in the recording layer so that a heat-sensitive recording material having a high sensitivity is effectively obtained.

DETAILED DESCRIPTION OF THE INVENTION

Our inventors have widely studied about the combination of basic chromogenic materials and stabilizers contained in the recording layer of heat-sensitive recording materials. Resultantly, it has been found that the image-retainability is remarkably improved in the state of maintaining the background area extremely less susceptible to lowering the brightness under high temperature condition, when the specific basic chromogenic materials, i.e., 3-di(n-butyl)amino-6-methyl-7-phenylaminofluoran and at least one selected from the group consisting of 3-(N-methyl-N-cyclohexyl)amino-6-methyl-7-phenylaminofluoran, 3-diethylamino-6-methyl-7-phenylaminofluoran and 3-(N-ethyl-N-tetrahydrofurfuryl)amino-6-methyl-7-phenylaminofluoran, are used together with the specific stabilizer, i.e., at least one selected from the group consisting of 1,1,3-tris(3-cyclohexyl-4-hydroxy-6-methylphenyl)butane, 1,1,3-tris(2-methyl-4-hydroxy-5-tert-butylphenyl)butane and 4,4'-cyclohexylidenediphenol, as described above.

The basic chromogenic material selected from group consisting of 3-(N-methyl-N-cyclohexyl)amino-6-methyl-7-phenylaminofluoran, 3-diethylamino-6-methyl-7-phenylaminofluoran and 3-(N-ethyl-N-tetrahydrofurfuryl)amino-6-methyl-7-phenylaminofluoran is preferably used in an amount of 5 to 95 parts by weight, particularly 10 to 75 parts by weight, per 100 parts by weight of 3-di(n-butyl)amino-6-methyl-7-phenylaminofluoran.

On the other hand, the used amount of the above stabilizer is preferably 5 to 500 parts by weight, particularly 10 to 300 parts by weight, per 100 parts by weight of 3-di(n-butyl)amino-6-methyl-7-phenylaminofluoran.

As the developers used with the above specific basic chromogenic materials in the invention, various known compounds may be used. The typical compounds are exemplified as follows: phenolic compounds, e.g., 4-tert-butylphenol, α-naphthol, β-naphthol, 4-acetylphenol, 4-tert-octylphenol, 4,4'-sec-butylidenediphenol, 4-phenylphenol, 4,4'-dihydroxy-diphenylmethane, 4,4'-isopropylidenediphenol, hydroquinone, 4,4'-(1,3-dimethylbutylidene)bisphenol, 4,4'-dihydroxydiphenylsulfide, 4,4'-thiobis(6-tert-butyl-3-methylphenol), 4,4'-dihydroxydiphenylsulfone, 4-hydroxy-4'-methyldiphenylsulfone, 4-hydroxy-4'-methoxydiphenysulfone, 4-hydroxy-4'-isopropoxydiphenylsulfone, 4-hydroxy-3',4'-trimethylenediphenylsulfone, 4-hydroxy-3',4'-tetramethylenediphenylsulfone, 3,4-dihydroxy-4'-methyldiphenylsulfone, bis(3-allyl-4-hydroxyphenyl)sulfone, 1,3-di[2-(4-hydroxyphenyl)-2-propyl]benzene, 1-[α-methyl-α-(4'-hydroxyphenyl)ethyl]-4-[α',α'-bis(4'- hydroxyphenyl)ethyl[benzene, hydroquinone monobenzyl ether, butyl bis(4-hydroxyphenyl)acetate, 4-hydroxy-benzophenone, 2,4-dihydroxybenzophenone, 2,4,4'-trihydroxybenzophenone, 2,2',4,4'-tetrahydroxybenzophenone, dimethyl 4-hydroxyphthalate, methyl 4-hydroxybenzoate, ethyl 4-hydroxybenzoate, propyl 4-hydroxybenzoate, sec-butyl 4-hydroxybenzoate, pentyl 4-hydroxybenzoate, phenyl 4-hydroxybenzoate, benzyl 4-hydroxybenzoate, tolyl 4-hydroxybenzoate, chlorophenyl 4-hydroxybenzoate, phenylpropyl 4-hydroxybenzoate, phenethyl 4-hydroxybenzoate, p-chlorobenzyl 4-hydroxybenzoate, p-methoxybenzyl 4-hydroxybenzoate, novolac phenol resin, phenol polymers and the like; aromatic carboxylic acids, e.g., benzoic acid, p-tert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3,5-di-tert-butylsalicylic acid, 3-benzylsalicylic acid, 3-(α-methylbenzyl)salicylic acid, 3-chloro-5-(α-methylbenzyl)salicylic acid, 3-phenyl-5-(α,α-dimethylbenzyl) salicylic acid, 3,5-di-α-methylbenzylsalicylic acid and the like; and salts of the above aromatic carboxylic acids with polyvalent metals such as zinc, magnesium, aluminum, calcium, titanium, manganese, tin and nickel; and organic acidic compounds and the like. These developers may be used solely or in combination.

The used ratio of the basic chromogenic material and the above color developer may be suitably selected depending on the kind of the basic chromogenic material and the color developer, and is not particularly limited. However, the used amount of the color developer is generally within the range of 100 to 700 parts by weight, preferably 150 to 400 parts by weight, per 100 parts by weight of the basic chromogenic material.

The heat-sensitive recording material according to the invention has an excellent characteristic such as extremely little lowering of brightness of the background area by fogging at high temperature even if a heat-fusible material is additionally comprised as a sensitizer in the recording layer, because the specific basic chromogenic materials are used with the specific stabilizer. Therefore, a heat-sensitive recording material having a high sensitivity, which is produced with the use of a heat-fusible material, can be very effectively obtained by the invention.

As the heat-fusible materials, various known compounds may be used. For example, fatty acid amides such as stearic acid amide, methylenebis stearic acid amide, oleic acid amide, palmitic acid amide, coconut aliphatic acid amide and the like; hindered phenols such as 2,2'-methylenebis(4-methyl-6-tert-butylphenol), 4,4'-butylidenebis(6-tert-butyl-3-methylphenol) and the like; ethers such as p-benzylbiphenyl, 1,2-bis(phenoxy)ethane, 1,2-bis(4-methylphenoxy)ethane, 1,2-bis(3-methylphenoxy)ethane, 2-napthol benzyl ether, benzyl-4-methyl thiophenyl ether and the like; esters such as dibenzyl terephthalate, phenyl 1-hydroxy-2-naphthoate and the like; ultraviolet ray absorbers such as 2-(2'-hydroxy-5'-methylphenyl)benztriazole, 2-hydroxy-4-benzyloxy-benzophenone and the like and various known heat-fusible materials may be added as a sensitizer. Among them, 1,2-bis(phenoxy)ethane and 1,2-bis(3-methylphenoxy)ethane are most preferably used for producing a high-sensitive recording material having good adaptability to recording instrument, because they have a high-compatibility with the specific basic chromogenic materials and the specific stabilizer in the present invention and a low melt viscosity. The used amount of the above heat-fusible material contained in the recording layer is not particularly limited, however, it is generally within the range of 50 to 500 parts by weight, preferably 100 to 300 parts by weight, per 100 parts by weight of the basic chromogenic material.

As described above, it is necessary in the invention to use the specific basic chromogenic materials. However, the other additional basic chromogenic material may be used with them within the range in which the desired advantages of the invention are not inhibited.

Among the additional basic chromogenic materials, there are included fluoran compounds such as 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-N-acetyl-N-methylaminofluoran, 3-diethylamino-7-N-methylaminofluoran, 3-diethylamino-7-dibenzylaminofluoran, 3-diethylamino-7-N-methyl-N-benzylaminofluoran, 3-diethylamino-7-N-chloroethyl-N-methylaminofluoran, 3-diethylamino-7-N-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-7-(2-carbomethoxyphenylamino)fluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, 3-pyrrolidino-6-methyl-7-p-butylphenylaminofluoran, 3-(N-methyl-N-n-amyl-)amino-6-methyl-7-phenylaminofluoran, 3-(N-ethyl-N-n-amyl)amino-6-methyl-7-phenylaminofluoran, 3-(N-ethyl-N-iso-amyl)amino-6-methyl-7-phenylaminofluoran, 3-(N-methyl-N-n-hexyl)amino-6-methyl-7-phenylaminofluoran, 3-(N-ethyl-N-n-hexyl)amino-6-methyl-7-phenylaminofluoran, 3-(N-ethyl-N-β-ethylhexyl)amino-6-methyl-7-phenylaminofluoran, 3-(N-ethyl-N-cyclopentyl)amino-6-methyl-7-phenylaminofluoran and the like.

When the additional basic chromogenic materials as described above are used, the used amount of them is preferably adjusted to not more than 20% by weight on the basis of the total amount of the basic chromogenic materials comprised in the recording layer.

The recording layer of the heat-sensitive recording material is generally produced by applying a coating composition on a substrate. The coating composition may be prepared by separately or together dispersing the basic chromogenic material, the color developer and the heat-fusible material in water with the use of a mixer or pulverizer such as ball mill, attritor, sand mill or the like.

The coating composition generally comprises a binder. As the binder, there may be used such as starches, hydroxyethylcellulose, methylcellulose, carboxymethylcellulose, gelatin, casein, gum arabic, polyvinyl alcohol, various modified polyvinyl alcohols such as carboxy-group modified, sulfone-group modified, acetoacetyl-group modified, silicone modified and the like, salts of styrene-maleic anhydride copolymer, salts of styrene-acrylic acid copolymer, styrene-butadiene copolymer emulsions and the like. The binder is preferably used in an amount of 2 to 40% by weight, more preferably 5 to 25% by weight on the basis of the total solid amount. The binder may be used in combination.

Further, if necessary, the coating composition may include various kinds of additives such as dispersing agents, e.g., sodium dioctylsulfosuccinate, sodium dodecylbenzenesulfonate, sodium salt of lauryl alcohol sulfate, metal salts of fatty acids and the like; antifoaming agents; fluorescent dyes; coloring dyes and the like.

To stably prevent sticking smudges on a recording head, the coating composition may also include inorganic pigments, e.g., kaolin, clay, talc, calcium carbonate, calcined clay, titanium dioxide, diatom earth, fine-grain anhydrous silica, activated clay and the like. Furthermore, the coating composition may also include a dispersion or emulsion containing stearic acid, polyethylene, carnauba wax, paraffin wax, zinc stearate, calcium stearate, ester wax and the like to prevent occurrence of sticking by contacting the coated layer with a recording head or recording instrument.

According to the invention, the method for forming the recording layer is not particularly limited. The recording layer may be formed by using various well-known techniques. For example, the recording layer is formed by a method in which the coating composition for the heat-sensitive recording layer is coated on a substrate and then dried. An air-knife coator, blade coator, bar coator, gravure coator, curtain coator and the like may be used as a coating machine.

The amount of the applied coating composition is not also particularly limited, however, it is generally controlled within the range of 1.5 to 12 g/m$^2$, preferably 2.5 to 10 g/m$^2$ on dry basis.

As the substrate, paper, plastic film, synthetic paper and the like may be used. Paper is most preferably used in terms of the cost and the coating suitability.

In thus obtained heat-sensitive recording material according to the present invention, each of the brightness of the background area and the optical density of the recorded images is stably maintained without serious lowering, even if the heat-sensitive recording material is exposed at high temperature, because the recording layer comprises the specific basic chromogenic materials together with the specific stabilizer. The excellent effects can be particularly obtained in a high-sensitive heat-sensitive recording material.

If necessary, a protective layer may be formed on the surface and/or the opposite surface of the heat-sensitive recording material and an under-coating layer may be formed between the substrate and the heat-sensitive recording layer. Furthermore, there may be applied additional various well-known methods for producing the heat-sensitive recording material, such as application of an adhesive and the like.

Preferred Embodiments of the Invention

The following examples serve to illustrate the invention in more detail although the invention is not limited to the examples. Unless otherwise indicated, parts and % signify parts by weight and % by weight, respectively.

EXAMPLE 1

① Formation of an Under-coating Layer

The following composition was mixed with stirring to prepare a coating composition. The coating composition was coated on a wood free paper of 50 g/m$^2$ in the weight of an amount of 10 g/m$^2$ on dry basis and dried to form an under-coating layer.

| | |
|---|---|
| calcined clay (Ansilex TM manufactured by EMC Co., Ltd.) | 100 parts |
| stylene-butadiene copolymer latex (solid content: 50%) | 15 parts |
| 10% aqueous solution of polyvinylalcohol | 30 parts |
| water | 200 parts |

② Preparation of Dispersion A

The following composition was passed through a sand mill, and the pulverization was continued until an average particle size of 2.0 μm.

| | |
|---|---|
| 3-di(n-butyl)amino-6-methyl-7-phenylaminofluoran | 7.5 parts |
| 3-(N-methyl-N-cyclohexyl)amino-6-methyl-7-phenylaminofluoran | 2.5 parts |
| 1,2-bis(3-methylphenoxy)ethane | 25 parts |
| 5% aqueous solution of methylcellulose | 30 parts |
| water | 20 parts |

③ Preparation of Dispersion B

The following composition was passed through a sand mill, and the pulverization was continued until an average particle size of 2.0 μm.

| | |
|---|---|
| 4,4'-isopropylidenediphenol | 30 parts |
| 5% aqueous solution of methylcellulose | 30 parts |
| water | 70 parts |

④ Preparation of Dispersion C

The following composition was passed through a sand mill, and the pulverization was continued until an average particle size of 20 μm.

| | |
|---|---|
| 1,1,3-tris(3-cyclohexyl-4-hydroxy-6-methylphenyl)butane | 5 parts |
| 5% aqueous solution of methylcellulose | 5 parts |
| water | 10 parts |

⑤ Formation of a Heat-sensitive Recording Material 85 parts of dispersion A, 130 parts of dispersion B, 20 parts of dispersion C, 30 parts of silicone dioxide pigment, 150 parts of 20% aqueous solution of oxidized starch, 55 parts of water were mixed with stirring to obtain a coating composition. Then thus obtained coating composition was coated in an amount of 4.5 g/m$^2$ on dry basis on the above under-coating layer and dried to obtain a heat-sensitive recording material.

EXAMPLE 2

A heat-sensitive recording material was obtained in the same manner as in Example 1 except that 9 parts of 3-di(n-butyl)amino-6-methyl-7-phenylaminofluoran and 1 part of 3-diethylamino-6-methyl-7-phenylaminofluoran were used instead of 7.5 parts of 3-di(n-butyl)amino-6-methyl-7-phenylaminofluoran and 2.5 parts of 3-(N-methyl-N-cyclohexyl)amino-6-methyl-7-phenylaminofluoran to prepare the dispersion A and 1,1,3-tris(2-methyl-4-hydroxy-5-tert-butylphenyl) butane was used instead of 1,1,3-tris(3-cyclohexyl-4-hydroxy-6-methylphenyl)butane to prepare the dispersion C.

EXAMPLE 3

A heat-sensitive recording material was obtained in the same manner as in Example 1 except that 6 parts of 3-di(n-butyl)amino-6-methyl-7-phenylaminofluoran and 4 parts of 3-(N-ethyl-N-tetrahydrofurfuryl)amino-6-methyl-7-phenylaminofluoran were used instead of 7.5 parts of 3-di(n-butyl)amino-6-methyl-7-phenylaminofluoran and 2.5 parts of 3-(N-methyl-N-cyclohexyl-)amino-6-methyl-7-phenylaminofluoran to prepare the dispersion A, 4-hydroxy-4'-isopropoxydiphenylsulfone was used instead of 4,4'-isopropylidenediphenol to prepare the dispersion B and 4,4'-cyclohexylidenediphenol was used instead of 1,1,3-tris(3-cyclohexyl-4-hydroxy-6-methylphenyl)butane to prepare the dispersion C.

EXAMPLE 4

A heat-sensitive recording material was obtained in the same manner as in Example 1 except that 4-hydroxy-4'-isopropoxydiphenylsulfone was used instead of 4,4'-isopropylidenediphenol to prepare the dispersion B.

COMPARATIVE EXAMPLE 1

A heat-sensitive recording material was obtained in the same manner as in Example 1 except that 10 parts of 3-di(n-butyl)amino-6-methyl-7-phenylaminofluoran was used instead of 7.5 parts of 3-di(n-butyl)amino-6-methyl-7-phenylaminofluoran and 2.5 parts of 3-(N-methyl-N-cyclohexyl)amino-6-methyl-7-phenylaminofluoran to prepare the dispersion A.

COMPARATIVE EXAMPLE 2

A heat-sensitive recording material was obtained in the same manner as in Example 1 except that 3-dibutylamino-7-(o-cholorophenylamino)fluoran was used instead of 3-(N-methyl-N-cyclohexyl)amino-6-methyl-7-phenylaminofluoran to prepare the dispersion A.

COMPARATIVE EXAMPLE 3

A heat-sensitive recording material was obtained in the same manner as in Example 1 except that 6 parts of 3-di(n-butyl)amino-6-methyl-7-phenylaminofluoran and 4 parts of 3-(N-ethyl-N-isoamyl)amino-6-methyl-7-phenylaminofluoran were used instead of 7.5 parts of 3-di(n-butyl)amino-6-methyl-7-phenylaminofluoran and 2.5 parts of 3-(N-methyl-N-cyclohexyl)amino-6-methyl-7-phenylaminofluoran to prepare the dispersion A and the dispersion C was not used.

COMPARATIVE EXAMPLE 4

A heat-sensitive recording material was obtained in the same manner as in Example 2 except that 10 parts of 3-di(n-butyl)amino-6-methyl-7-phenylaminofluoran was used instead of 9 parts of 3-di(n-butyl)amino-6-methyl-7-phenylaminofluoran and 1 part of 3-diethylamino-6-methyl-7-phenylaminofluoran to prepare the dispersion A in Example 2.

COMPARATIVE EXAMPLE 5

A heat-sensitive recording material was obtained in the same manner as in Comparative Example 4 except that 4,4'-cyclohexylidenediphenol was used instead of 1,1,3-tris(2-methyl-4-hydroxy-5-tert-butylphenyl)butane to prepare the dispersion C in Comparative Example 4.

COMPARATIVE EXAMPLE 6

A heat-sensitive recording material was obtained in the same manner as in Example 3 except that the dispersion C in Example 3 was not used.

COMPARATIVE EXAMPLE 7

A heat-sensitive recording material was obtained in the same manner as in Example 1 except that 3-(N-ethyl-N-isoamyl)amino-6-methyl-7-phenylaminofluoran was used instead of 3-di(n-butyl)amino-6-methyl-7-phenylaminofluoran to prepare the dispersion A.

COMPARATIVE EXAMPLE 8

A heat-sensitive recording material was obtained in the same manner as in Example 3 except that 3-(N-ethyl-N-isoamyl)amino-6-methyl-7-phenylaminofluoran was used instead of 3-di(n-butyl)amino-6-methyl-7-phenylaminofluoran to prepare the dispersion A in Example 3.

COMPARATIVE EXAMPLE 9

A heat-sensitive recording material was obtained in the same manner as in Example 3 except that 10 parts of 3-di(n-butyl)amino-6-methyl-7-phenylaminofluoran was used instead of 6 parts of 3-di(n-butyl)amino-6-methyl-7-phenylaminofluoran and 4 parts of 3-(N-ethyl-N-tetrahydrofurfuryl)amino-6-methyl-7-phenylaminofluoran to prepare the dispersion A in Example 3.

COMPARATIVE EXAMPLE 10

A heat-sensitive recording material was obtained in the same manner as in Example 2 except that 9 parts of 3-di(n-butyl)amino-6-methyl-7-phenylaminofluoran and 1 part of 3-dibutylamino-7-(o-chlorophenylamino)fluoran were used instead of 9 parts of 3-di(n-butyl)amino-6-methyl-7-phenylaminofluoran and 1 part of 3-diethylamino-6-methyl-7-phenylaminofluoran to prepare the dispersion A in Example 2.

COMPARATIVE EXAMPLE 11

A heat-sensitive recording material was obtained in the same manner as in Example 3 except that 6 parts of 3-di(n-butyl)amino-6-methyl-7-phenylaminofluoran and 4 parts of 3-dibutylamino-7-(o-chlorophenylamino)fluoran were used instead of 6 parts of 3-di(n-butyl)amino-6-methyl-7-phenylaminofluoran and 4 parts of 3-(N-ethyl-N-tetrahydrofurfuryl)amino-6-methyl-7-phenylaminofluoran to prepare the dispersion A in Example 3.

COMPARATIVE EXAMPLE 12

A heat-sensitive recording material was obtained in the same manner as in Example 1 except that the dispersion C was not used.

COMPARATIVE EXAMPLE 13

A heat-sensitive recording material was obtained in the same manner as in Example 2 except that the dispersion C in Example 2 was not used.

COMPARATIVE EXAMPLE 14

A heat-sensitive recording material was obtained in the same manner as in Example 2 except that 9 parts of 3-(N-ethyl-N-isoamyl)amino-6-methyl-7-phenylaminofluoran and 1 part of 3-diethylamino-6-methyl-7-phenylaminofluoran were used instead of 9 parts of 3-di(n-butyl)amino-6-methyl-7-phenylaminofluoran and 1 part of 3-diethylamino-6-methyl-7-phenylaminofluoran to prepare the dispersion A in Example 2.

COMPARATIVE EXAMPLE 15

A heat-sensitive recording material was obtained in the same manner as in Example 1 except that 10 parts of 3-(N-ethyl-N-isoamyl)amino-6-methyl-7-phenylaminofluoran was used instead of 7.5 parts of 3-di(n-butyl-)amino-6-methyl-7-phenylaminofluoran and 2.5 parts of 3-(N-methyl-N-cyclohexyl)amino-6-methyl-7-phenylaminofluoran to prepare the dispersion A, benzyl 4-hydroxybenzoate was used instead of 4,4'-isopropylidenediphenol to prepare the dispersion B, the used amount of 1,1,3-tris(3-cyclohexyl-4-hydroxy-6-methylphenyl)butane was increased to 10 parts to prepare the dispersion C, and the used amount of the dispersion C was increased to 25 parts in the formation of a heat-sensitive recording material.

COMPARATIVE EXAMPLE 16

A heat-sensitive recording material was obtained in the same manner as in Comparative Example 15 except that 3-dibutylamino-7-(o-chlorophenylamino)fluoran was used instead of 3-(N-ethyl-N-isoamyl)amino-6-methyl-7-phenylaminofluoran to prepare the dispersion A in Comparative Example 15.

Thus obtained 20 heat-sensitive recording materials were passed through a high-speed thermal facsimile (Panafax UF-60 manufactured by Matsushita Denso Kabushiki Kaisha) to develop color images. The obtained optical density of the developed color images and the background area without color images (unrecorded portion) were measured by Macbeth densitometer RD-914 type manufactured by Macbeth Corp. The results are shown in Table 1.

Further, the heat-sensitive recording materials after developing color images were allowed to stand for 3 days in an atmosphere of 40° C., 50% RH, and then the optical density of the developed color images and the background area without color images were measured by Macbeth densitometer to evaluate the retainability under high temperature condition. The results are shown in Table 1.

TABLE 1

| | Optical density | | | |
|---|---|---|---|---|
| | Immediately after developing color images | | After heat-treatment*1) | |
| | Color images | Background area | Color images | Background area |
| Example | | | | |
| 1 | 1.29 | 0.05 | 1.08 | 0.07 |
| 2 | 1.31 | 0.05 | 1.06 | 0.09 |
| 3 | 1.28 | 0.05 | 1.10 | 0.07 |
| 4 | 1.28 | 0.05 | 1.11 | 0.08 |
| Comparative Example | | | | |
| 1 | 1.30 | 0.05 | 0.85 | 0.06 |
| 2 | 1.25 | 0.05 | 0.85 | 0.07 |
| 3 | 1.34 | 0.06 | 0.98 | 0.24 |
| 4 | 1.30 | 0.05 | 0.91 | 0.08 |
| 5 | 1.29 | 0.05 | 0.89 | 0.07 |
| 6 | 1.31 | 0.05 | 0.93 | 0.07 |
| 7 | 1.37 | 0.07 | 1.19 | 0.28 |
| 8 | 1.33 | 0.06 | 1.13 | 0.21 |
| 9 | 1.27 | 0.05 | 0.92 | 0.07 |

TABLE 1-continued

| | Optical density | | | |
|---|---|---|---|---|
| | Immediately after developing color images | | After heat-treatment*1) | |
| | Color images | Background area | Color images | Background area |
| 10 | 1.29 | 0.05 | 0.87 | 0.08 |
| 11 | 1.24 | 0.05 | 0.87 | 0.07 |
| 12 | 1.30 | 0.05 | 0.94 | 0.07 |
| 13 | 1.31 | 0.05 | 0.88 | 0.09 |
| 14 | 1.39 | 0.07 | 1.22 | 0.33 |
| 15 | 1.33 | 0.06 | 0.90 | 0.30 |
| 16 | 1.22 | 0.05 | 0.70 | 0.07 |

*1)After heat-treatment at 40° C., 50% RH for 3 days

As shown in Table 1, each of the heat-sensitive recording materials obtained in Examples according to the present invention is superior in the image-retainabily and the brightness of the background area under high temperature condition.

The invention may be embodied in order specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What we claim:

1. A heat-sensitive recording material comprising a recording layer formed on a substrate where said recording layer comprises a colorless or pale colored basic chromogenic material, a color developing material which develops a color by contacting with said chromogenic material, and a stabilizer, characterized in that said recording layer comprises at least one selected from the group consisting of 3-(N-methyl-N-cyclohexyl)amino-6-methyl-7-phenylaminofluoran, 3-diethylamino-6-methyl-7-phenylaminofluoran and 3-(N-ethyl-N-tetrahydrofurfuryl)amino-6-methyl-7-phenylaminofluoran together with 3-di(n-butyl)amino-6-methyl-7-phenylaminofluoran as said chromogenic material, and at least one selected from the group consisting of 1,1,3-tris(3-cyclohexyl-4-hydroxy-6-methylphenyl)butane, 1,1,3-tris(2-methyl-4-hydroxy-5-tert-butylphenyl)butane and 4,4'-cyclohexylidenedip henol as said stabilizer.

2. A heat-sensitive recording material as defined in claim 1, wherein at least one basic chromogenic material selected from the group consisting of 3-(N-methyl-N-cyclohexyl)amino-6-methyl-7-phenylaminofluoran, 3-diethylamino-6-methyl-7-phenylaminofluoran and 3-(N-ethyl-N-tetrahydrofurfuryl)amino-6-methyl-7-phenylaminofluoran is present in an amount from 5 to 95 parts by weight per 100 parts by weight of 3-di(n-butyl)amino-6-methyl-7-phenylaminofluoran.

3. A heat-sensitive recording material as defined in claim 1, wherein said stabilizer is present in an amount from 5 to 500 parts by weight per 100 parts by weight of 3-di(n-butyl)amino-6-methyl-7-phenylaminofluoran.

4. A heat-sensitive recording material as defined in claim 1, wherein said color developing material is present in an amount from 100 to 700 parts by weight per 100 parts by weight of the total basic chromogenic materials.

5. A heat-sensitive recording material as defined in claim 1, wherein a heat-fusible material is further comprised in said recording layer.

6. A heat-sensitive recording material as defined in claim 5, wherein said heat-fusible material is present in an amount from 50 to 500 parts by weight per 100 parts by weight of the total basic chromogenic materials.

* * * * *